United States Patent [19]

Hough

[11] Patent Number: 4,485,701

[45] Date of Patent: Dec. 4, 1984

[54] TOOL FOR REMOVING BASES OF BROKEN LIGHT BULBS

[76] Inventor: Gregory L. Hough, 6102 Maywood Forest, Houston, Tex. 77088

[21] Appl. No.: 455,850

[22] Filed: Jan. 5, 1983

[51] Int. Cl.[3] ..... B25B 13/52

[52] U.S. Cl. ..... 81/64

[58] Field of Search ..... 81/64, 446, 448, 449; 294/93, 19 A, 20

[56] References Cited

U.S. PATENT DOCUMENTS

| | | | |
|---|---|---|---|
| 2,545,043 | 3/1951 | Odenthal | 294/20 |
| 2,637,587 | 5/1953 | Robinson | 294/20 |
| 2,760,807 | 8/1956 | Watson | 294/19 A |
| 2,983,541 | 5/1961 | Maki | 294/20 |
| 3,284,123 | 11/1966 | Adams | 294/20 |

*Primary Examiner*—James L. Jones, Jr.
*Attorney, Agent, or Firm*—Neal J. Mosely

[57] ABSTRACT

A hand tool for removing light bulb bases from conventional light bulb sockets is disclosed with a tubular central portion comprising a handle and one end of said tool comprising a light bulb base removal member. The light bulb base removal member is made of rubber or equivalent elastomeric material and comprises a cylindrical shank portion, a tapered conical portion, and a thin cylindrical flange portion insertable in a light bulb base for enclosing filament tubes and gripping and removing the base from a socket.

3 Claims, 3 Drawing Figures

TOOL FOR REMOVING BASES OF BROKEN LIGHT BULBS

BACKGROUND OF THE INVENTION

1. Field of the Invention

This invention relates in general to the field of hand tools and, more particularly to a novel tool for removing the base of a broken light bulb from the light bulb socket and further capable of enclosing broken filament tubes during removal.

2. Brief Description of the Prior Art

Tools for removing the bases of broken light bulbs from an electrical socket are known in the prior art. They have evolved as result of the difficulty encountered when attempting to rotate a broken light bulb in its socket to effect removal therefrom. Usually the only portion of the remaining light bulb consists of jagged glass and exposed filaments. This can be a considerable safety hazard. Some prior devices are designed to remove unbroken bulbs or fuses from their sockets, and a few devices are adapted to be insertable into the light bulb base.

Grinnell, U.S. Pat. No. 1,319,028 discloses a lamp base remover insertable into the base of a broken light bulb comprising a series of steel cutting and reaming blades. The tool is used to ream out the remaining glass filament tube and insulation in the base and the cutting edges are to engage the rim of the base for removal. The tool is of necessity composed of metal which would make it unsafe to use around electrical sockets.

Chadsey, U.S. Pat. No. 2,117,017 discloses a tool for removing unbroken and broken light bulbs. The tool is composed of an elastomeric material having a bell shaped member at one end for manipulating unbroken bulbs and a tapered ribbed portion at the other end to engage the base of a broken light bulb. The tool has a hole through its center for inserting it on a handle and for gripping a filament. It would appear difficult to remove the base by gripping the filament tube because it is a glass tube and difficult to grip the base because the filament tube inside the tapered ribbed portion would prevent proper deformation to affect sufficient contact with the light bulb base.

Greene, U.S. Pat. No. 3,797,055 discloses a combination light bulb removing tool and socket cleaner. The tool is a unitary metal construction and has a conical light bulb base gripping member with longitudinal radial flange members having sharp edges to cut into and grip the base. The flange members are not flexible and would only grip when turned in one direction.

Zuracki, U.S. Pat. No. 3,238,822 and Dowick, U.S. Pat. No. 1,859,767 are of interest but are directed toward tools for removing fuses.

The prior art in general, and none of these patents in particular, disclose the present invention which has a cylindrical shank portion, a tapered conical portion, and a thin horizontal cylindrical flange portion insertable in a light bulb base for enclosing filament tubes and gripping and safely and efficiently removing the base from an electrical socket.

SUMMARY OF THE INVENTION

It is therefore an object of the present invention to provide a tool for removing light bulb bases which is safe in its operation around electrical sockets.

Another object of this invention is to provide a tool for removing light bulb bases which is simple in construction and inexpensive to manufacture.

Another object of this invention is to provide a tool for removing light bulb bases which is simple in operation.

Another object of this invention is to provide a tool for removing light bulb bases which will encompass the exposed filaments of broken light bulbs safely during the removal process.

Other objects of the invention will become apparent from time to time throughout the specification and claims as hereinafter related.

The above noted objects and other objects of the invention are accomplished by hand tool for removing light bulb bases from conventional light bulb sockets with a tubular central portion comprising a handle, and one end of said tool comprising a light bulb base removal member. The light bulb base removal member is of rubber or equivalent elastomeric material and is comprised of a cylindrical shank portion, a tapered conical portion, and a thin horizontal cylindrical flange portion insertable in a light bulb base for enclosing filament tubes and gripping and removing the base from a socket.

DESCRIPTION OF THE PREFERRED EMBODIMENT

Figure 1:
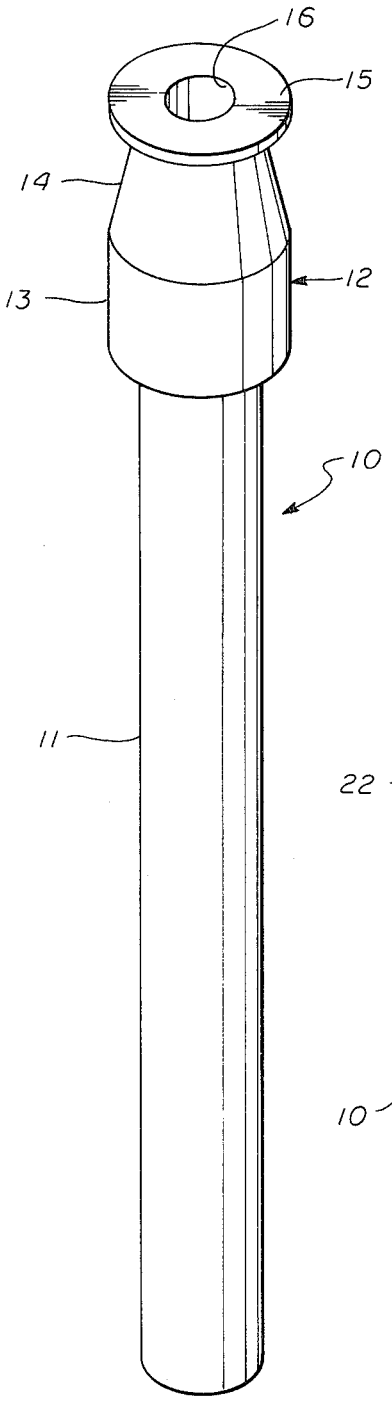
FIG. 1 is an isometric view of a preferred embodiment of a tool for removing light bulb bases.
Figure 2:
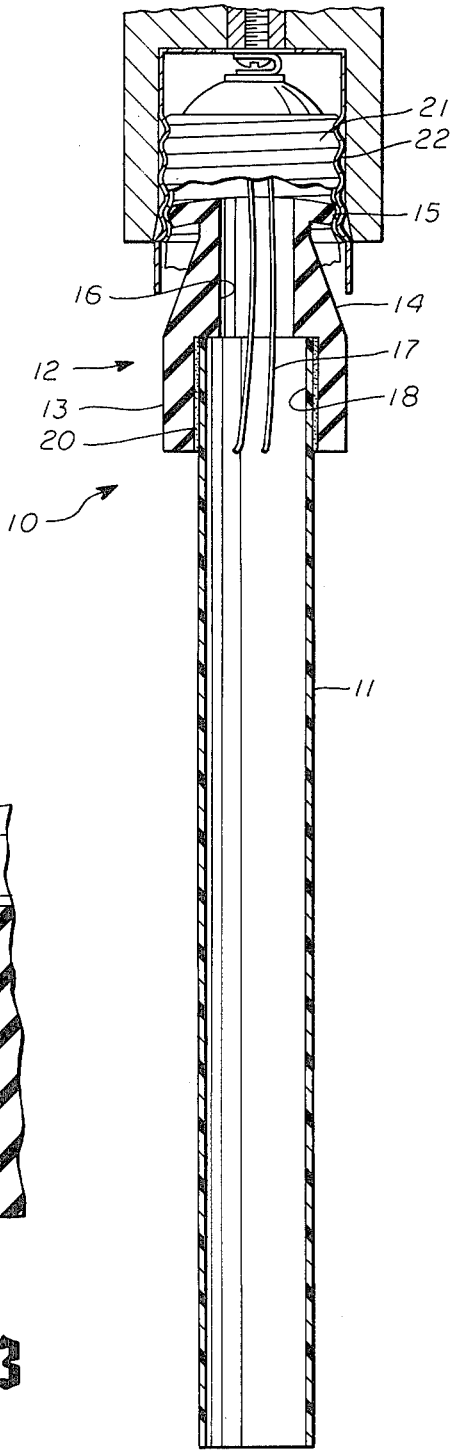
FIG. 2 is a view in longitudinal cross section of the tool shown in FIG. 1.

Referring to the drawings by numerals of reference, and more particularly to FIGS. 1 and 2, the tool 10 for removing light bulb bases from sockets comprises a hollow tubular central handle 11 of an insulating material, such as extruded rubber or plastic, or wood. A light bulb base removal member 12 is attached to one end of the the handle 11.

The light bulb base removal member 12 is molded of rubber or equivalent elastomeric material and comprises a cylindrical shank portion 13, a tapered conical portion 14, and a laterally-extending, thin flexible disc-shaped flange portion 15. An opening 16 is contained centrally within light bulb removal member 12 and is of sufficient diameter and length to encompass a filament tube or exposed filaments 17 as shown in FIG. 2.

A second opening or bore 18 which is larger in diameter than opening 16 extends centrally within cylindrical shank portion 13 and forms a shoulder 19 therebetween. Bore 18 is of sufficient diameter and length to receive one end of handle 11 in abutment with seat 19. A bonding agent 20 applied to a portion of the outside diameter of handle 11 assures a strong union between the base removal member 12 and the handle 11. Alternatively, the handle 11 may be of a size fitting the bore 18 by a stretch or interference fit.

OPERATION

Figure 3:
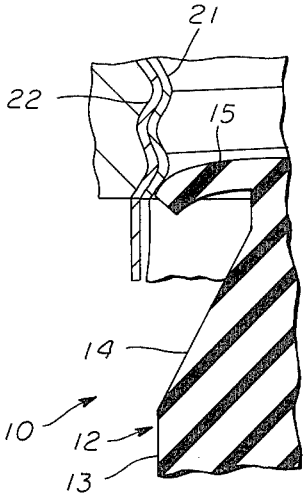
FIG. 3 is an enlarged cross sectional detail illustrating an operational procedure of the preferred embodiment.

Referring now to FIGS. 2 and 3, the operation of removing a broken light bulb from its socket is illustrated. The metal base 21 of a broken light bulb is shown threaded into an electrical socket 22. The light bulb base removal tool 10 is inserted upwardly into the base 21.

Filaments 17 are safely received in the opening 16. As the flange portion 15 enters the base 21 it will contact the threaded portion of the base 21 and be deformed thereby. Turning the handle 11 will further deform the flange 15 causing an interference fit of the flange 15 inside the base 21. When the light bulb base removal tool 10 is securely in place, the handle 11 is rotated to unscrew the base 21 of the broken light bulb from the electrical socket 22. The broken light bulb is then discarded, thus providing a safe efficient method of removing broken light bulbs from their sockets. The size of the flange 15 is such that a variety of sizes of light bulb bases may be removed.

While this invention has been described fully and completely with special emphasis upon a preferred embodiment, it should be understood that within the scope of the appended claims the invention may be practiced otherwise than is specifically described herein.

I claim:

1. A tool for removing bases of broken light bulbs from electrical sockets comprising;

a hollow tubular handle member of an electric insulating material, and a hollow, deformable light bulb removal member of an electric insulating material securely affixed to one end thereof, said light bulb removal member being of soft flexible elastomeric material having a hollow cylindrical shank portion fitting over an end of said hollow handle member, a tapered portion extending therefrom, enlarged end portion surrounding the end of said tapered portion of a size larger than the base of a normal size light bulb and adapted to be compressibly or flexibly deformed to fit tightly inside the base of a broken light bulb and having a central opening open to the bore of said handle for encompassing filaments or filament tubes of a broken light bulb for removing said broken bulb from an electric socket.

2. The tool according to claim 1 wherein said light bulb removal member has a peripherally extending flange of a size to be deformed on insertion into the base of a broken light bulb.

3. The tool according to claim 1 wherein said light bulb removal member comprises a hollow cylindrical shank portion adapted to receive one end of said handle member, a tapered conical portion extending therefrom, a flexible, thin, disc-shaped, flange portion extending laterally from said conical portion and adaptable to be deformed for internally gripping the base of a broken light bulb, and a longitudinally extending opening centrally disposed within said light bulb removal member and open to the bore of the hollow handle for encompassing exposed filaments or filament tubes.

* * * * *